US008339329B2

(12) United States Patent
Shen

(10) Patent No.: US 8,339,329 B2
(45) Date of Patent: Dec. 25, 2012

(54) ANTENNA MOUNT

(75) Inventor: Wen-Chao Shen, Bade (TW)

(73) Assignee: Azure Shine International Inc., Bade (TW)

( * ) Notice: Subject to any disclaimer, the term of this patent is extended or adjusted under 35 U.S.C. 154(b) by 559 days.

(21) Appl. No.: 12/702,626

(22) Filed: Feb. 9, 2010

(65) Prior Publication Data

US 2011/0193764 A1 Aug. 11, 2011

(51) Int. Cl.
*H01Q 1/12* (2006.01)
*H01Q 3/02* (2006.01)

(52) U.S. Cl. ..... 343/882; 343/878; 343/718

(58) Field of Classification Search ..... 343/882, 343/878, 718
See application file for complete search history.

(56) References Cited

U.S. PATENT DOCUMENTS 7,439,930 B2 10/2008 Bury

FOREIGN PATENT DOCUMENTS

WO WO 99/41802 8/1999
WO WO 2009/081163 7/2009

OTHER PUBLICATIONS

*Search and Examination Report* of GB Application No. 1002111.1 issued by the UK Patent Office on May 24, 2010.

*Primary Examiner* — Douglas W Owens
*Assistant Examiner* — Collin Dawkins
(74) *Attorney, Agent, or Firm* — Alston & Bird LLP

(57) ABSTRACT

An antenna mount for a satellite antenna comprises an adjustment plate with a first cam slot, a first bracket and a first cam. The first bracket includes a first base, a first sidewall extending from the first base and having a second cam slot aligned with the first cam slot, and a second sidewall extending in parallel with the first sidewall from the first base. The first cam is adapted to attach the adjustment plate to an inner surface of the first sidewall. The first cam includes a first shaft protruding from the first sidewall through the first and second cam slots and rotatable with respect to the first sidewall, and a first disc coupled with the first shaft and adapted to fit within the first cam slot so that the adjustment plate is rotatable with respect to the first sidewall as the first shaft is rotated from the exterior of the first sidewall.

30 Claims, 9 Drawing Sheets

ANTENNA MOUNT

TECHNICAL FIELD

The present invention relates generally to satellite communications and, more particularly, to an antenna mount for a satellite antenna.

BACKGROUND

Thanks to the rapid development of satellite technology, high-speed data transmission for long-range communications is feasible nowadays. For optimal performance, it may be necessary for a satellite antenna to be precisely aligned with a target signal source. Alignment of a satellite antenna may generally be performed via an adjustable antenna mount, in which a movable connection is typically incorporated. The movable connection may include, for example, one or more cam(s) along with a number of slots for antenna mount adjustment. In some antenna mounts, as one disclosed in U.S. Pat. No. 7,439,930 to Bury, a cam structure may be coupled with a stationary member such as a bracket of the antenna mount by fastening connection. Such connection, however, may require several sets of bolts and nuts, which may inevitably incur an increase in material cost and assembly time.

BRIEF SUMMARY

Examples of the present invention may provide an antenna mount for a satellite antenna. The antenna mount may include an adjustment plate with a first cam slot, a first bracket and a first cam. The first bracket includes a first base, a first sidewall and a second sidewall. The first sidewall extends from the first base and has a second cam slot aligned with the first cam slot. The second sidewall extends in parallel with the first sidewall from the first base. The first cam is adapted to attach the adjustment plate to an inner surface of the first sidewall. Furthermore, the first cam includes a first shaft and a first disc coupled with the first shaft. The first shaft protrudes from the first sidewall through the first and second cam slots and rotatable with respect to the first sidewall. The first disc is adapted to fit within the first cam slot so that the adjustment plate is rotatable with respect to the first sidewall as the first shaft is rotated from the exterior of the first sidewall.

Some examples of the present invention may also provide an antenna mount for a satellite antenna. The antenna mount may include a first bracket, an adjustment plate, a first cam, a second bracket and a second cam. The first bracket includes a first sidewall, a second sidewall extending in parallel with and spaced apart from the first sidewall, a first flange extending between the first and second sidewall and a second flange between the first and second sidewall extending in parallel with and spaced apart from the first flange. The adjustment plate is attached to an inner surface of the first sidewall. The first cam includes a first shaft and a first disc. The first shaft protrudes from the first sidewall and rotatable with respect to the first sidewall. The first disc, coupled with the first shaft, is adapted to rotate the adjustment plate with respect to the first sidewall as the first shaft is rotated from the exterior of the first sidewall. The second bracket includes a third sidewall attached to the first flange and a fourth sidewall attached to the second flange. The second cam includes a second shaft and a second disc. The second shaft protrudes from the third sidewall and rotatable with respect to the third sidewall. The second disc, coupled with the second shaft, is adapted to rotate the first bracket with respect to the third sidewall as the second shaft is rotated from the exterior of the third sidewall.

Examples of the present invention may further provide an antenna mount for a satellite antenna. The antenna mount may include an adjustment plate with a first cam slot, a first bracket, a first cam and a second cam. The first bracket includes a first sidewall and a first flange including a recess. The first cam is adapted to attach the adjustment plate to the first sidewall. Furthermore, the first cam includes a first shaft and a first disc coupled with the first shaft. The first disc is adapted to fit within the first cam slot so as to allow the adjustment plate to rotate in a first tangential direction. The second cam includes a second shaft and a second disc coupled with the second shaft. The second disc is adapted to fit within the recess so as to allow the first bracket to rotate in a second tangential direction orthogonal to the first tangential direction.

Other objects, advantages and novel features of the present invention will be drawn from the following detailed embodiments of the present invention with attached drawings, in which:

BRIEF DESCRIPTION OF THE DRAWINGS

The foregoing summary as well as the following detailed description of the preferred embodiments of the present invention will be better understood when read in conjunction with the appended drawings. For the purposes of illustrating the invention, there are shown in the drawings examples which are presently preferred. It is understood, however, that the invention is not limited to the precise arrangements and instrumentalities shown. In the drawings.

DETAILED DESCRIPTION

Reference will now be made in detail to the present examples of the invention illustrated in the accompanying drawings. Wherever possible, the same reference numbers will be used throughout the drawings to refer to the same or like portions.

Figure 1:
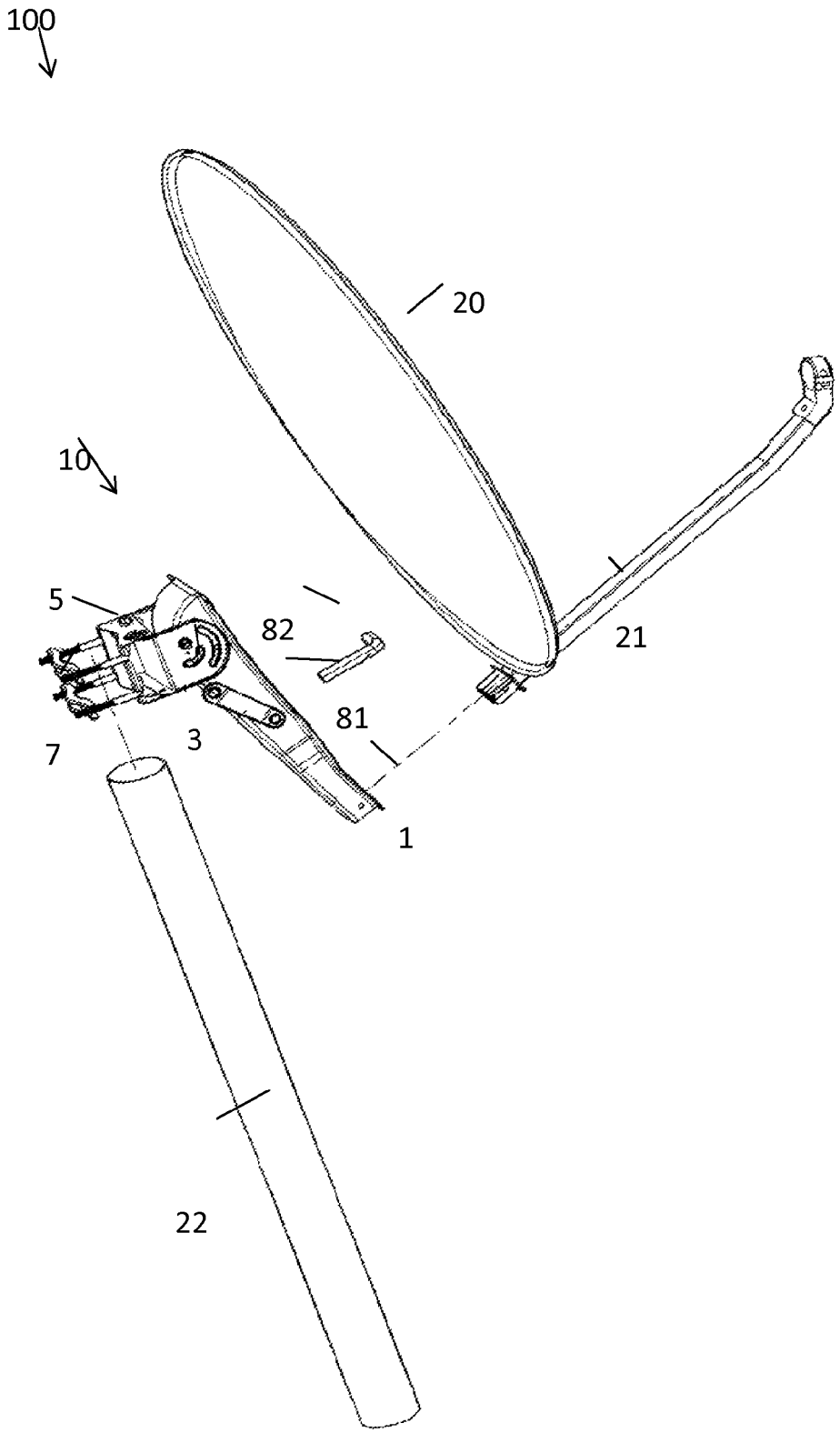
FIG. 1 is a perspective view of a satellite antenna in accordance with an example of the present invention.

FIG. 1 is a perspective view of a satellite antenna 100 in accordance with an example of the present invention. Referring to FIG. 1, the satellite antenna 100 may include an antenna mount 10 and an antenna dish 20. Moreover, the antenna mount 10 may include a connecting member 1, an elevation adjustment member 3, an azimuth adjustment member 5 and a clamp 7. The connecting member 1 may be adapted to couple with a connecting arm 21 of the satellite antenna 100. The clamp 7 may be adapted to secure the antenna mount 10 to a mounting pole 22. The elevation adjustment member 3 and the azimuth adjustment member 5 may be respectively adjusted in elevation angle and azimuth angle by using a wrench, for example, an open-end wrench 81 or a box-end wrench 82, which will be discussed in paragraphs below.

Figure 2A:
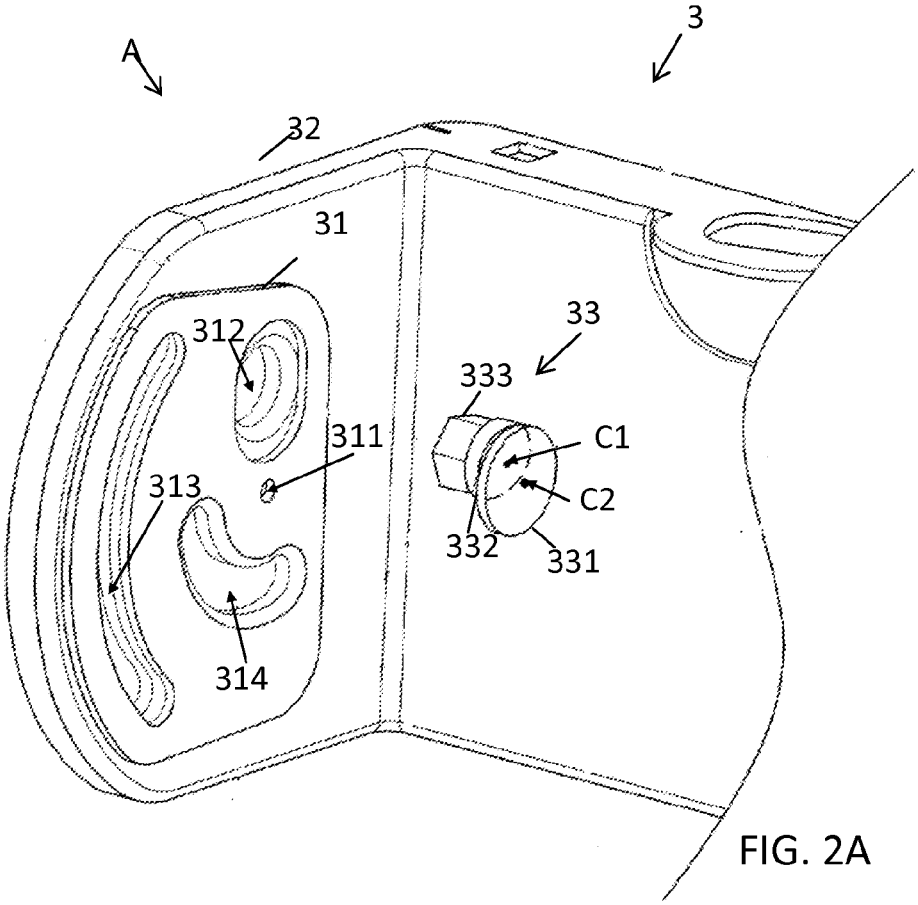
FIG. 2A is a fragmentary perspective view of an elevation adjustment member of the satellite antenna illustrated in FIG. 1.

FIG. 2A is a fragmentary perspective view of the elevation adjustment member 3 illustrated in FIG. 1. Referring to FIG. 2A, the elevation adjustment member 3 may include an adjustment plate 31, a first bracket 32 and a first cam 33. The adjustment plate 31, which may take the form of a planar sheet, has a first pivot hole 311, a first cam slot 312, a first guide slot 313 and a first pivot slot 314. In the present example, the first guide slot 313 may have a curved shape with a center of curvature at the first pivot hole 311. The first guide slot 313 may be adapted to confine the movement of the connecting member 1 within a predetermined arc length with respect to the first bracket 32. Furthermore, the first pivot slot 314 may have a curved shape with a center of curvature at the first pivot hole 311. The first pivot slot 314 may be adapted to confine the movement of the adjustment plate 31 within a predetermined arc length with respect to the first bracket 32. Skilled persons in the art will understand that the curve-shaped first guide slot 313 may have a curvature different from that of the curve-shaped first pivot slot 314. The shapes, arc lengths and curvatures of the first guide slot 313 and first pivot slot 314 should not be construed to limit the scope of the present invention in any manner not explicitly set forth in the appended claims.

The first cam 33 may include a disc 331, a shaft 333 and a connecting portion 332 between the disc 331 and the shaft 333. The connecting portion 332, which may include but is not limited to a cylindrical shape, may be coaxial with the shaft 333 at a first point C1. The shaft 333 may have but is not limited to a hexagonal shape so as to facilitate the adjustment of the first cam 33 by a tool such as the open-end wrench 81 or the box-end wrench 82 from the exterior of the first bracket 32. The disc 331 may include a circular disc with a center at a second point C2, wherein the first and second points C1 and C2 are eccentric with respect to each other. In other examples, the disc 331 may have a non-circular shape (not shown) with a geometrical center at the first point C1.

Figure 2B:
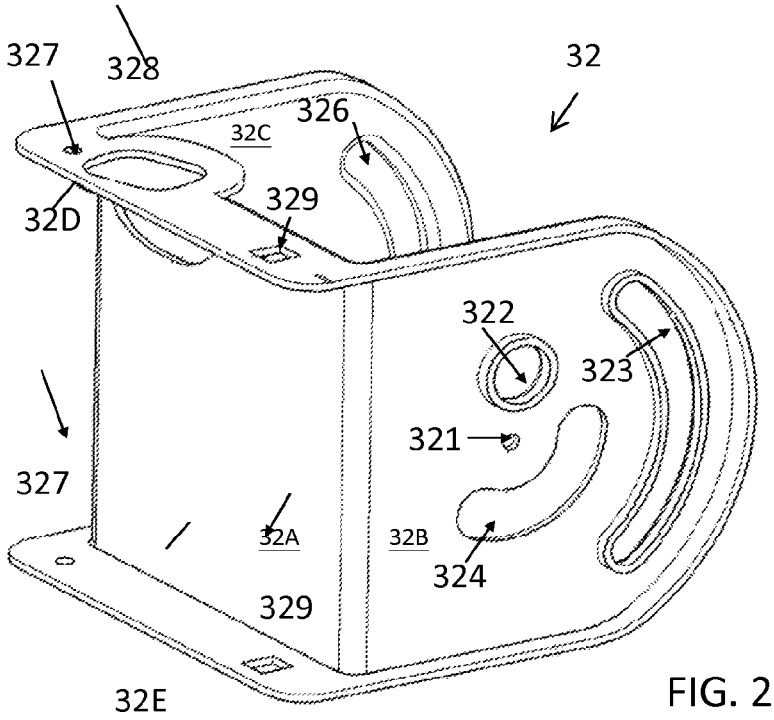
FIG. 2B is a perspective view of a first bracket of the elevation adjustment member as viewed in a direction "A" in FIG. 2A in accordance with an example of the present invention.

FIG. 2B is a perspective view of the first bracket 32 of the elevation adjustment member 3 as viewed in a direction "A" illustrated in FIG. 2A. Referring to FIG. 2B, the first bracket 32 may include a base 32A and a pair of first and second sidewalls 32B and 32C extending in parallel with each other from the base 32A. The first sidewall 32B has a second pivot hole 321, a second cam slot 322, a second guide slot 323 and a second pivot slot 324. The shaft 333 of the first cam 33 may protrude from the first sidewall 32B through the first and second cam slots 312, 322 and rotatable with respect to the first sidewall 32B. The shapes or profiles and the relative positions of the second pivot hole 321, second cam slot 322, second guide slot 323 and second pivot 324 may be respectively similar to those of the first pivot hole 311, first cam slot 312, first guide slot 313 and first pivot slot 314 described and illustrated with reference to FIG. 2A. Accordingly, when the adjustment plate 31 is attached to an inner surface (not numbered) of the first sidewall 32B, the second pivot hole 321, second cam slot 322, second guide slot 323 and second pivot slot 324 may be aligned with the first pivot hole 311, first cam slot 312, first guide slot 313 and first pivot slot 314 of the adjustment plate 31, respectively. In one example, the second cam slot 322 may have a size or diameter smaller than that of the first cam slot 312.

Figure 5:
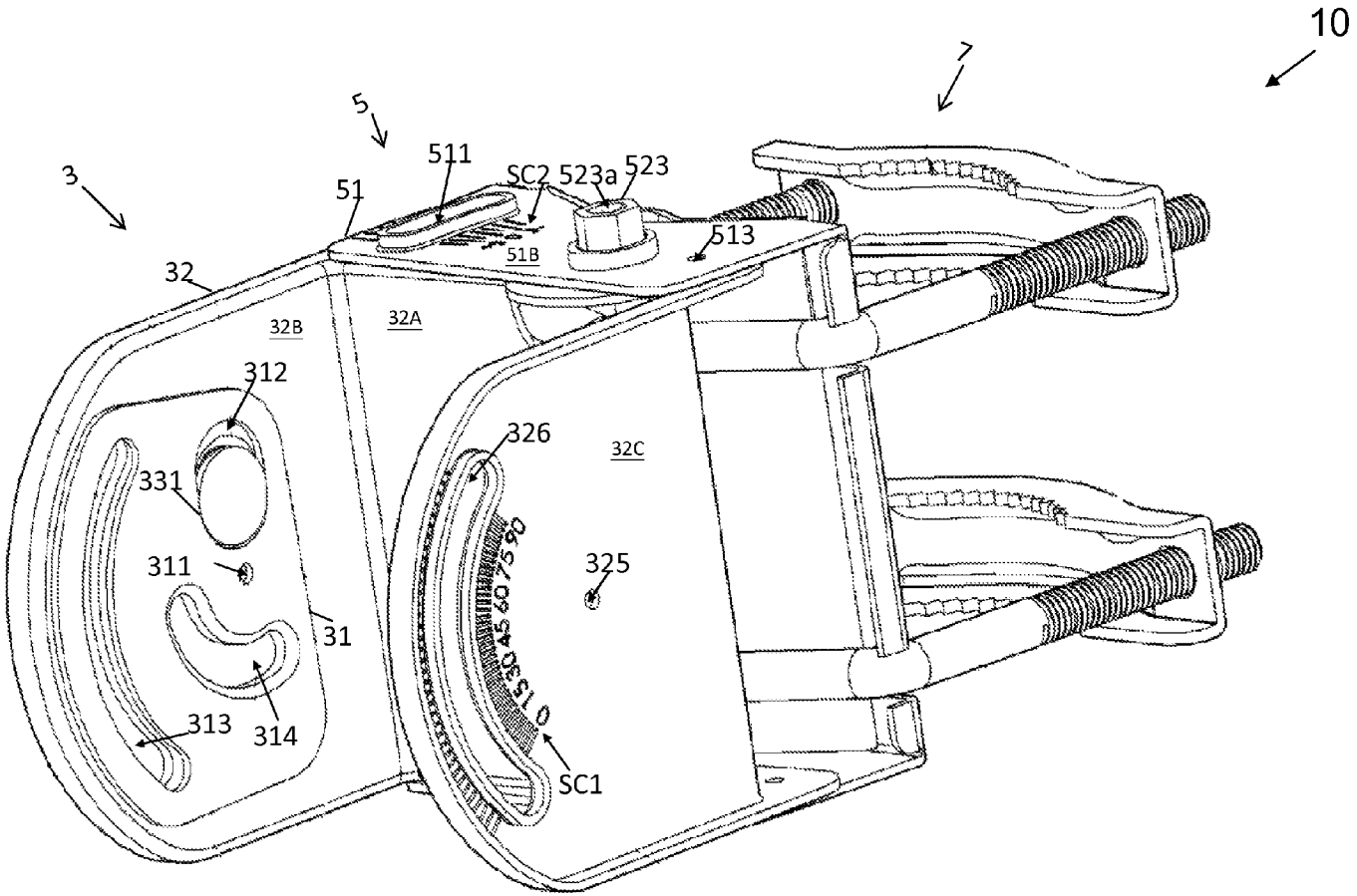
FIG. 5 is a perspective view of an antenna mount illustrated in FIG. 1 in accordance with an example of the present invention.

The second sidewall 32C may have a third guide slot 326 and a third pivot hole 325 (illustrated in FIG. 5). The shapes or profiles and the relative positions of the third pivot hole 325 and third guide slot 326 may be respectively similar to those of the second pivot hole 321 and second guide slot 323. Accordingly, when the adjustment plate 31 is attached to the inner surface of the first sidewall 32B, the second pivot hole 321 and second guide slot 323 of the adjustment plate 31 may be aligned with the third pivot hole 325 and third guide slot 326, respectively.

The first bracket 32 may further include a first and a second flanges 32D and 32E each extending from a side (not numbered) of the base 32A between the sidewalls 32B and 32C and being flush with the sidewalls 32B and 32C. In the present example, the flanges 32D and 32E may substantially extend away from the sidewalls 32B and 32C. The first and second flanges 32D and 32E may each have a fourth pivot hole 327 and a mounting hole 329 and the first flange 32D may further include a recess 328. The recess 328 may be adapted to hold a disc of a second cam, which will be discussed later by reference to FIG. 5. The fourth pivot holes 327 of the flanges 32D and 32E may be aligned with each other as the mounting holes 329 of the flanges 32D and 32E are aligned with each other and vice versa.

Figure 2C:
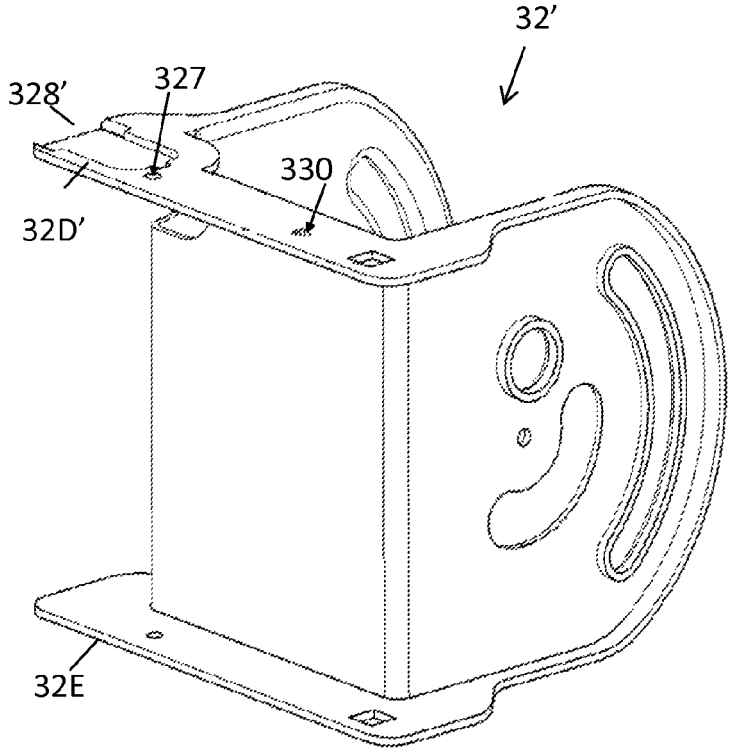
FIG. 2C is a perspective view of a first bracket in accordance with another example of the present invention.

FIG. 2C is a perspective view of a first bracket 32' in accordance with another example of the present invention. Referring to FIG. 2C, the first bracket 32' may be similar to the first bracket 32 described and illustrated with reference to FIG. 2B except that, for example, a first flange 32D' may include a recess 328' having an open end (not numbered) at the peripheral of the first flange 32D'. The open-end recess 328' may facilitate loading/unloading of the second cam onto/off the first flange 32D'. The first flange 32D' may further include an indicator 330, which may take the form of a triangular hole, for pointing to an azimuth reading.

Figure 2D:
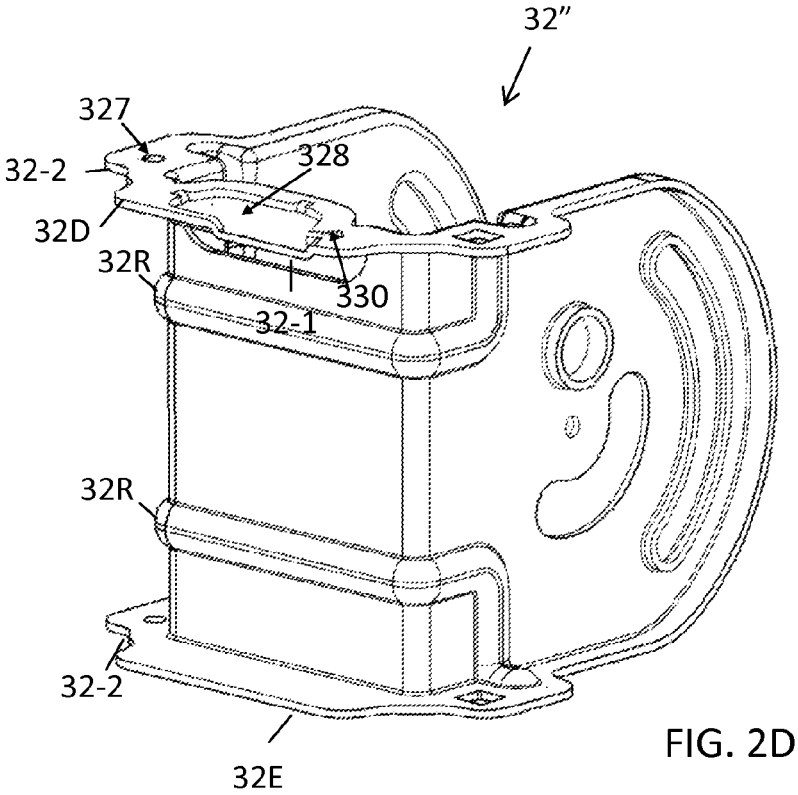
FIG. 2D is a perspective view of a first bracket in accordance with still another example of the present invention.

FIG. 2D is a perspective view of a first bracket 32" in accordance with still another example of the present invention. Referring to FIG. 2D, the first bracket 32" may be similar to the first bracket 32 described and illustrated with reference to FIG. 2B except that, for example, one or more ribs 32R may be provided to reinforce the first bracket 32". In the present example, the ribs 32R may extend across the base 32A from one of the sidewalls 32B and 32C to another.

Furthermore, the first flange 32D may include a depressed section 32-1 near the recess 328. The depressed section 32-1 may be bent toward the second flange 32E and may facilitate loading/unloading of the second cam onto/off the first flange 32D. Moreover, each of the first and second flanges 32D and 32E may include a notch 32-2 at one or more of its corners.

Figure 3A:
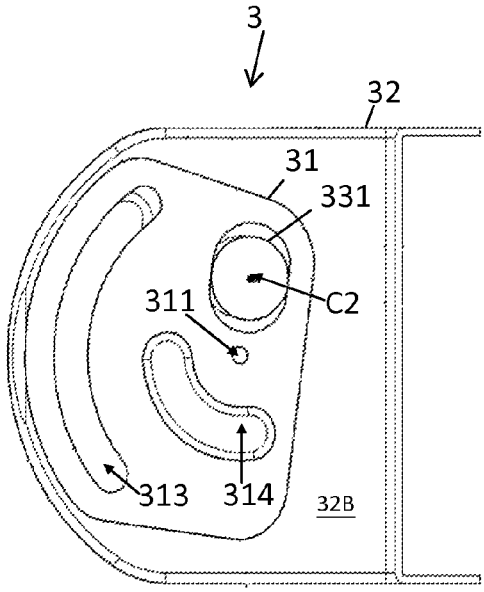
FIGS. 3A to 3C are diagrams illustrating a method of operating the elevation adjustment member illustrated in FIG. 2A in accordance with an example of the present invention.
Figure 3B:
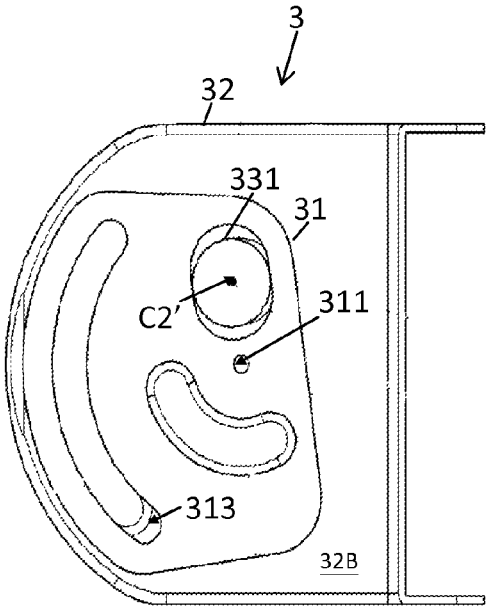
Figure 3C:
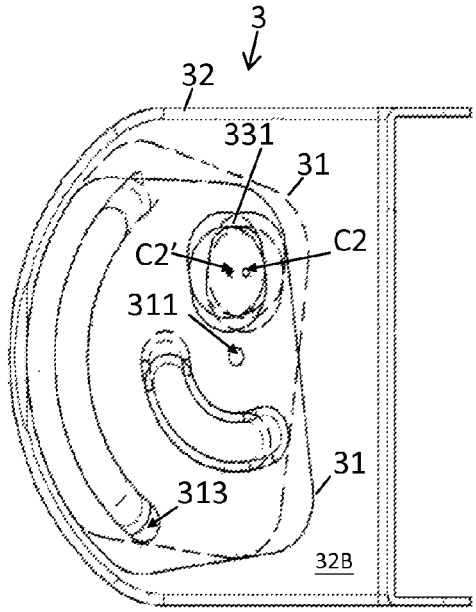

FIGS. 3A to 3C are diagrams illustrating a method of operating the elevation adjustment member 3 illustrated in FIG. 2A. Referring to FIG. 3A, the adjustment plate 31 may be attached to an inner surface (not numbered) of the first sidewall 32B by setting the first cam 33 into the first cam slot 311 and the second cam slot 322 so that the disc 331 of the first cam 33, either circular or non-circular, may be fitted into the first cam slot 311 to engage snugly with the adjustment plate 31. Accordingly, the rotary motion of the first cam 33 may cause the adjustment plate 31 to rotate about the first pivot hole 311. A fastener (not shown), such as a set of bolt and nut, may be used to couple the adjustment plate 31 to the first sidewall 32B through the first pivot hole 311, which allows the adjustment plate 31 to pivot around the first pivot hole 311.

Referring to FIG. 3B, by rotating the shaft 333 with an appropriate tool, for example, the wrench 81 or 82 illustrated in FIG. 1, the adjustment plate 31 may pivot around the first pivot hole 311 as the shaft 333 and in turn the disc 331 rotate about the first center C1. For example, the shaft 333 may rotate counterclockwise so that the center of the disc 331 may move from the point C2 to another point C2'.

Referring to FIG. 3C, the adjustment plate 31 and the disc 331 are rotated from the position (shown in phantom) illustrated in FIG. 3A to another position illustrated in FIG. 3B. Also referring to FIG. 1, the connecting member 1, which will be discussed by reference to FIG. 6, may translate the rotary motion to the antenna dish 20. Elevation angles of the satellite antenna 100 may thereby be adjusted.

Figure 4:
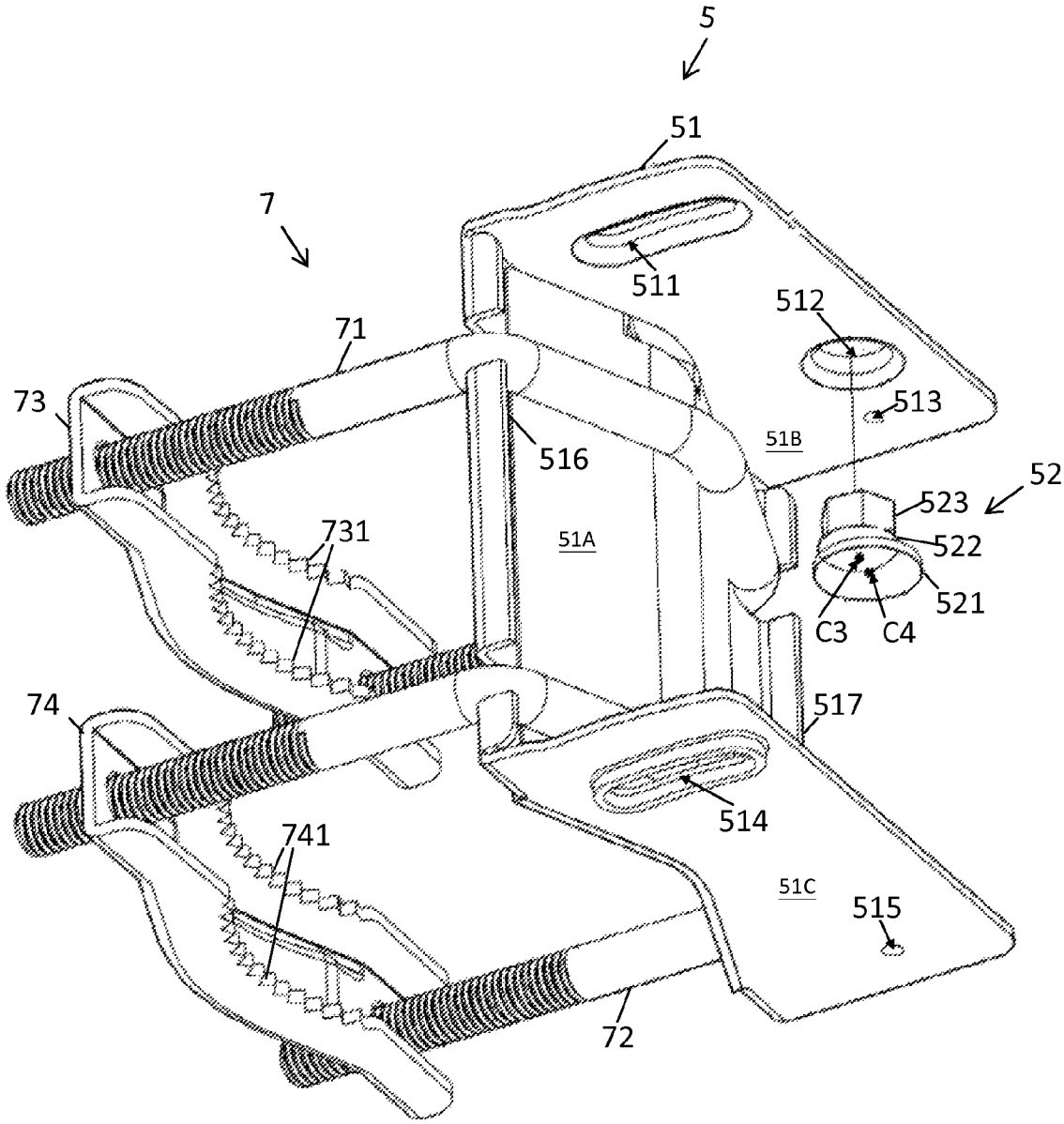
FIG. 4 is a perspective view of the azimuth adjustment member and the clamp of the satellite antenna illustrated in FIG. 1 in accordance with an example of the present invention.

FIG. 4 is a perspective view of the azimuth adjustment member 5 and the clamp 7 of the satellite antenna 100 illustrated in FIG. 1 in accordance with an example of the present invention. Referring to FIG. 4, the azimuth adjustment member 5 may include a second bracket 51 and a second cam 52. The second cam 52 may include a disc 521, a shaft 523 and a connecting portion 522 between the disc 521 and the shaft 523. The shapes or profiles of the disc 521, the connecting portion 522 and the shaft 523 may be similar to those of the disc 331, the connecting portion 332 and the shaft 333 of the first cam 33 described and illustrated with reference to FIG. 2A.

The second bracket 51 may include a base 51A and a pair of first and second sidewalls 51B and 51C extending in parallel with each other from the base 51A. The first sidewall 51B has a first indicator slot 511, a third cam slot 512 and a fifth pivot hole 513. The shaft 523 may protrude from the first sidewall 51B through the third cam slot 512 and rotatable with respect to the first sidewall 51B of the second bracket 51. The second sidewall 51C has a second indicator slot 514 and a sixth pivot hole 515. The shapes or profiles and the relative positions of the fifth pivot hole 513 and first indicator slot 511 may be respectively similar to those of the sixth pivot hole 515 and second indicator slot 514. Accordingly, the fifth pivot hole 513 and first indicator slot 511 may be aligned with the sixth pivot hole 515 and second indicator slot 514, respectively.

The connecting portion 522, which may include but is not limited to a cylindrical shape, may be coaxial with the shaft 523 at a first point C3. The shaft 523 may include but is not limited to a hexagonal shape so as to facilitate the adjustment of the second cam 52 by the wrench 81 or 82 illustrated in FIG. 1 from the exterior of the second bracket 51. The disc 521 may include a circular disc with a center at a second point C4, wherein the first and second points C3 and C4 are eccentric with respect to each other. In other examples, the disc 521 may have a non-circular shape (not shown) with a geometrical center at the first point C3.

The second bracket 51 may further include a first and a second flanges 516 and 517 each extending from a side (not numbered) of the base 51A between the sidewalls 51B and 51C. Each of the flanges 516 and 517 has a pair of openings (not numbered) to allow a pair of U-shaped bars 71 and 72 of the clamp 7 to extend through across the base 51A. The pair of U-shaped bars 71 and 72 may include threaded portions (not numbered) to facilitate the engagement with a pair of clamping members 73 and 74 of the clamp 7. Each of the clamping members 73 and 74 may include sawtooth portions 731 and 741 for securely clamping the mounting pole 22 shown in FIG. 1.

FIG. 5 is a perspective view of the antenna mount 10 illustrated in FIG. 1. Referring to FIG. 5, an elevation scale SC1 may be arranged along the third guide slot 326 on an outer surface of the second sidewall 32C of the first bracket 32. When the first cam 33 is rotated, the elevation scale SC1 may facilitate the adjustment of the antenna dish 20 for a desired elevation angle.

Moreover, an azimuth scale SC2 may be arranged near the first indicator slot 511 on an outer surface of the first sidewall 51B of the second bracket 51. In another example, the azimuth scale SC2 may be arranged near the second indicator slot 514 on an outer surface of the second sidewall 51C of the second bracket 51. One or more of the first and second indicator slots 511 and 514 may expose an indicator such as the azimuth indicator 330 illustrated in FIG. 2C. When the second cam 52 is rotated, the azimuth scale SC2 together with the azimuth indicator 30 may facilitate the adjustment of the antenna dish 20 for a desired azimuth angle.

To assemble the elevation adjustment member 3 and the azimuth adjustment member 5, the first and second flanges 32D and 32E of the first bracket 32 of the elevation adjustment member 3 may be attached to the first and second sidewalls 51B and 51C of the second bracket 51 of the azimuth adjustment member 5. Specifically, the disc 521 of the second cam 52 may be placed in the recess 328 of the first flange 32D of the first bracket 32, and then the shaft 523 of the second cam 52 may be placed in the fifth pivot hole 513 of the first sidewall 51B of the second bracket 51. The disc 521 may be sized to fit snugly within the recess 328 so that when the shaft 523 is rotated by a wrench from the exterior of the first sidewall 51B, the first bracket 32 may rotate about the fifth pivot hole 513. The tangential direction of the rotary motion of the first bracket 32 with respect to the second cam 52 may be orthogonal to that of the rotary motion of the adjustment plate 31 with respect to the first cam 33.

Figure 6:
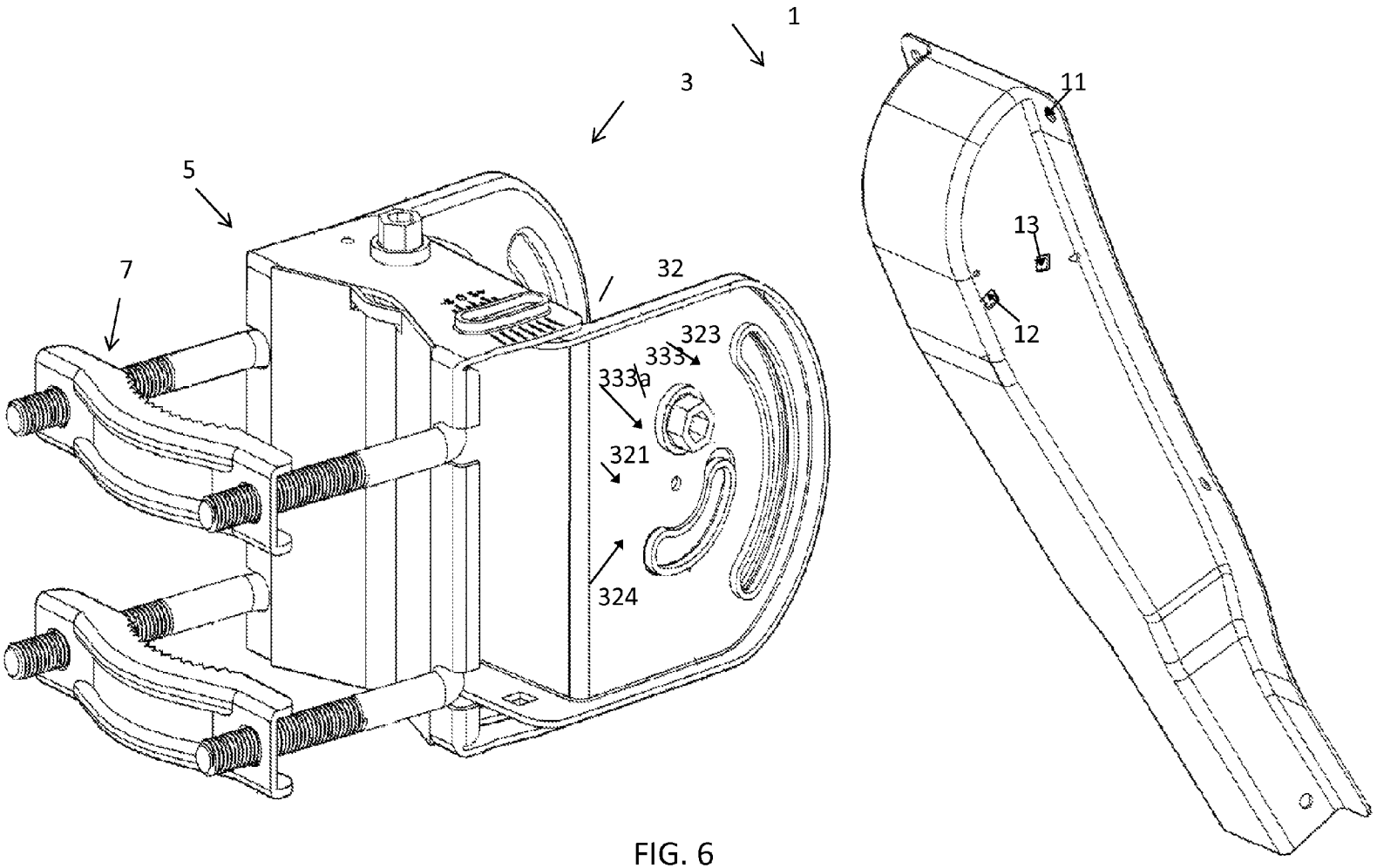
FIG. 6 is a perspective view of an antenna mount illustrated in FIG. 1 in accordance with another example of the present invention.

FIG. 6 is a perspective view of the antenna mount 10 of the satellite antenna 100 illustrated in FIG. 1. Referring to FIG. 6, the connecting member 1 may have a pair of pivot holes 12, a pair of mounting holes 13 and a number of connection holes 11. The connection holes 11 may facilitate the connecting member 1 to couple with the connecting arm 21. Furthermore, the pivot holes 12 and mounting holes 13 may facilitate the connecting member 1 to couple with the elevation adjustment member 3. Specifically, the connecting member 1 may be connected to the connecting arm 21 illustrated in FIG. 1 by a number of fasteners (not shown) through the connection holes 11. Also referring to FIGS. 2A and 6, the elevation adjustment member 3 may be connected to the connecting member 1 by a fastener (not shown) through the pivot holes 12, 311, 321 and 325, and further by another fastener (not shown) through the mounting hole 13 and the guide slots 323 and 313.

In operation, when the first cam 33 is rotated with respect to a first plane, i.e., the first sidewall 32B of the first bracket 32, the connecting member 1 coupled with the adjustment plate 31 may move along in the guide slots 313, 323 and 326 so that the rotary motion of the adjustment plate 31 may be translated via the connecting arm 21 to the antenna dish 20. Elevation angles of the antenna dish 20 of the satellite antenna 100 may thereby be adjusted. Moreover, when the second cam 52 is rotated with respect to a second plane, i.e., the first sidewall 51B of the second bracket 51, the connecting member 1 coupled with the elevation adjustment member 3 may pivot about the second cam 52 as the first bracket 32 pivots about the second cam 52 so that the rotary motion of the first bracket 32 may be translated via the connecting arm 21 to the antenna dish 20. Azimuth angles of the antenna dish 20 may thereby be adjusted.

Figure 7A:
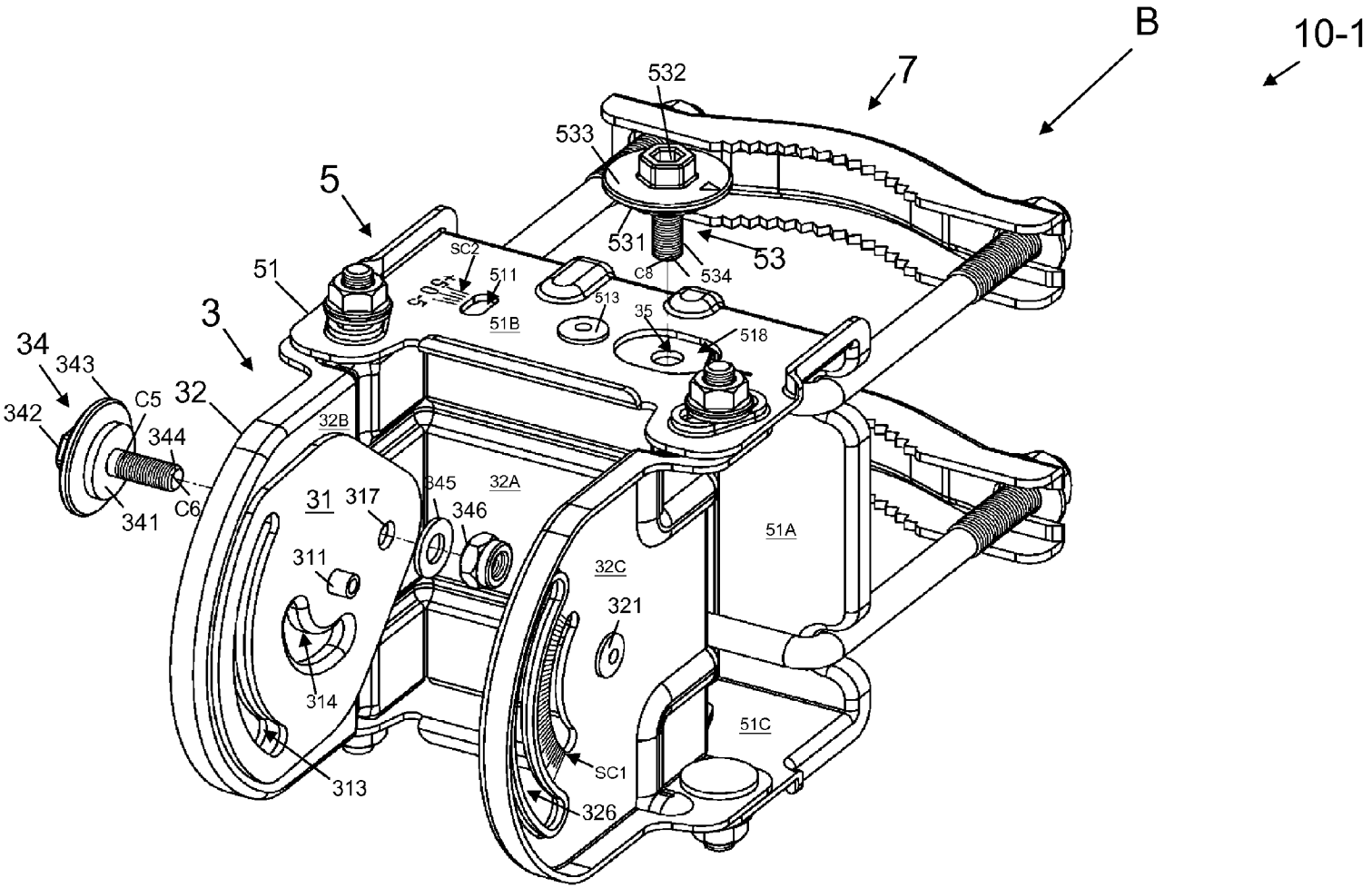
FIG. 7A is a perspective view of an antenna mount in accordance with still another example of the present invention.

FIG. 7A is a perspective view of an antenna mount 10-1 in accordance with still another example of the present invention. Referring to FIG. 7A, the antenna mount 10-1 may be similar to the antenna mount 10 described and illustrated with reference to in FIG. 5 except that, for example, the elevation adjustment member 3 and the azimuth adjustment member 5 of the antenna mount 10-1 may include a first cam device 34 and a second cam device 53 in place of the first cam 33 and the second cam 52 of the antenna mount 10, respectively. Moreover, a first cam hole 317, a first cam slot 37, a second cam hole 35 of the elevation adjustment member 3 and a second cam slot 518 of the azimuth adjustment member 5 of the antenna mount 10-1 may take place of the first, the second cam slot 312, 322, the recess 328 and the third cam slot 512 of the antenna mount 10, respectively.

The first cam device 34 may be similar in function to the first cam 33, i.e., to adjust the elevation angle, even though the first cam device 34 may include a different mechanical structure and operate in a different manner. Specifically, the first cam device 34 may include a first disc 341, a shaft 342 and a second disc 343 between the first disc 341 and the shaft 342. The first disc 341 may include a circular disc with a center at a first point C5. The function of the first disc 341 is substantially the same as the disc 331 of the first cam 33, which will be discussed later. The shaft 342 may be substantially the same as the shaft 333 of the first cam 33 in both structure and function and thus may facilitate the adjustment of the first cam device 34 by a tool from the exterior of the first bracket 32. The second disc 343 may include a circular disc with a center at a second point C6, wherein the first and second points C5 and C6 are eccentric with respect to each other. The size or diameter of the second disc 343 may be greater than that of the first disc 341. Moreover, the first cam device 34 may further include a threaded bar 344, a washer 345 and a screw nut 346. The threaded bar 344, which may have a cylindrical shape, may be coaxial with the shaft 342 and second disc 343 at the second point C6. The threaded bar 344 may be plugged into the first sidewall 32B of the first bracket 32 through the first cam slot 37 and the first cam hole 317, and is rotatable with respect to the first sidewall 32B. The threaded bar 344 may be locked with the screw nut 346 through the washer 345 so that the adjustment plate 31 may be attached to an inner surface (not numbered) of the first sidewall 32B. The first disc 341 may be therefore fitted into the first cam slot 37 to engage snugly with the first sidewall 32B, which will be discussed below.

Figure 7B:
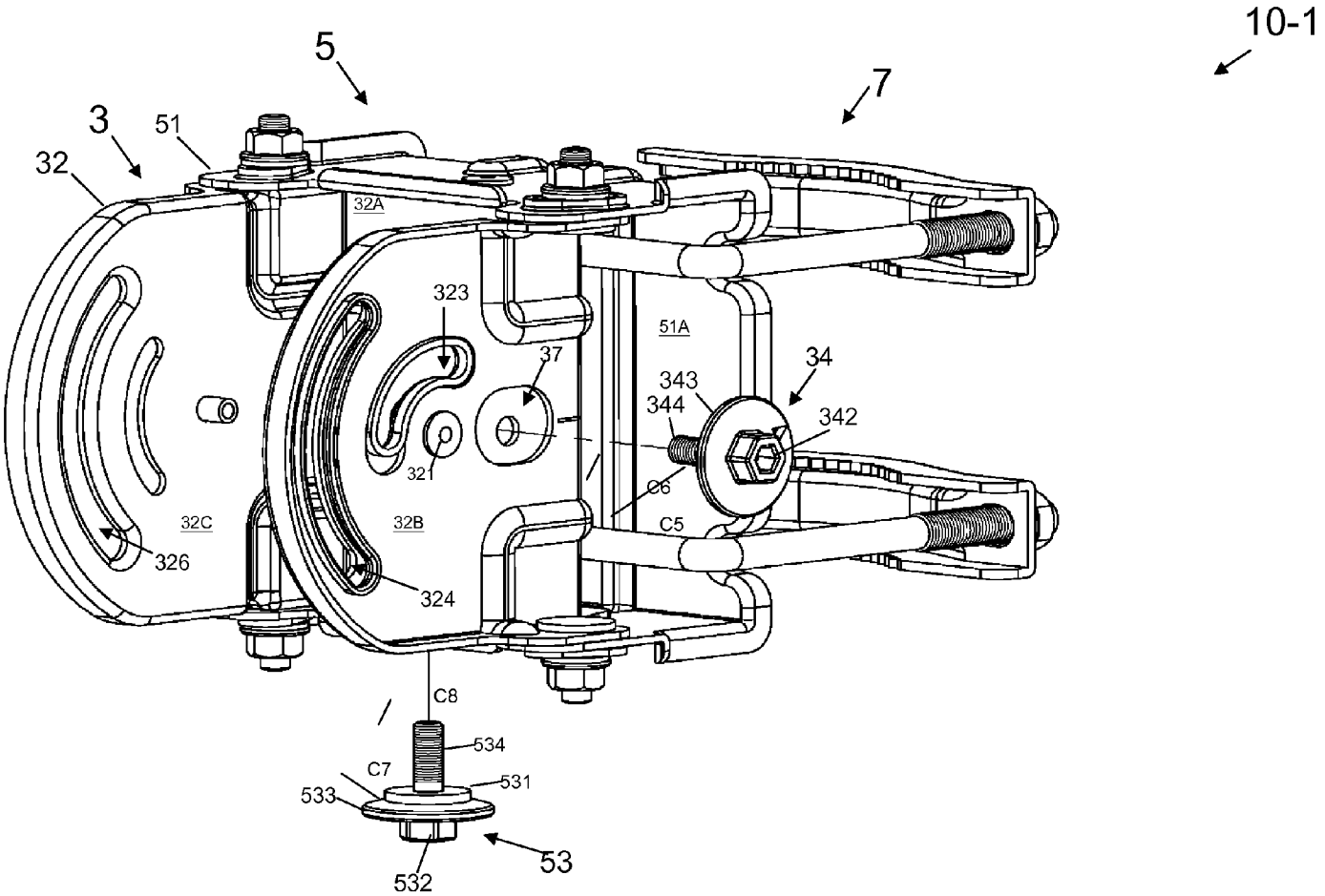
FIG. 7B is still a perspective view of the antenna mount 10-1 illustrated in FIG. 7A.

FIG. 7B is a perspective view of the antenna mount 10-1 illustrated in FIG. 7A. Referring to FIG. 7B, the first cam slot 37 may be disposed on the outer surface (not numbered) of the first sidewall 32B, to which the first disc 341 may be fitted. The first cam slot 37 may have a size or diameter greater than that of the first cam hole 317. By adjusting the first cam device 34, i.e., applying a force to cause a rotary motion of the first cam device 34 via the shaft 342, the adjustment plate 31 may rotate about the second pivot hole 321 in a fashion similar to the rotation of the adjustment plate 31 of the antenna mount 10 described and illustrated through FIG. 3A to FIG. 3C. Accordingly, the adjustment plate 31 may be adjusted in elevation angle.

Referring back to FIG. 7A, the second cam device 53 for the adjustment of azimuth angle may be similar to the first cam device 34 in both structure and operating manner. Specifically, the second cam device 53 may include a first disc 531, a shaft 532 and a second disc 533 between the first disc 531 and the shaft 532. The first disc 531 may include a circular disc with a center at a first point C7, the shaft 532 may be of a hexagonal shape, and the second disc 533 may include a circular disc with a center at a second point C8 and a size or diameter greater than that of the first disc 531. The second cam device 53 may include a threaded bar 534, a washer 535 and a screw nut 536 (not shown in FIG. 7A). The threaded bar 534, which may have a cylindrical shape, may be coaxial with the shaft 532 and second disc 533 at the second point C8, which is eccentric with the first point C7. The threaded bar 534 may be plugged into the first sidewall 51B of the second bracket 51 through the second cam slot 518 and the second cam hole 35, and is rotatable with respect to the first sidewall 51B. The threaded bar 344 may be locked with the screw nut 536 through the washer 535 so that the first bracket 32 may be attached to an inner surface (not numbered) of the first sidewall 51B. The first disc 531 may be therefore fitted into the second cam slot 518 to engage snugly with the first sidewall 51B, wherein the second cam slot 518 may be disposed on the outer surface (not numbered) of the first sidewall 51B of the second bracket 51. The second cam slot 518 may have a size or diameter greater than that of the second cam hole 35. By adjusting the second cam device 53, i.e., applying a force to cause a rotary motion of the second cam device 53 via the shaft 532, the elevation adjustment member 3 may rotate about the fifth pivot hole 513 and therefore adjusted in azimuth angle.

In describing representative examples of the present invention, the specification may have presented the method and/or process of operating the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

What is claimed is:

1. An antenna mount for a satellite antenna, the antenna mount comprising:

an adjustment plate with a first cam slot;

a first bracket comprising:

a first base;

a first sidewall extending from the first base and having a second cam slot aligned with the first cam slot; and a second sidewall extending in parallel with the first sidewall from the first base; and a first cam adapted to attach the adjustment plate to an inner surface of the first sidewall, the first cam comprising:

a first shaft protruding from the first sidewall through the first and second cam slots and rotatable with respect to the first sidewall; and a first disc coupled with the first shaft and adapted to fit within the first cam slot so that the adjustment plate is rotatable with respect to the first sidewall as the first shaft is rotated from the exterior of the first sidewall.

2. The antenna mount of claim 1, wherein the first shaft is rotatable with respect to the first sidewall about a first coaxial point, and the first disc includes a circular profile having a first center point eccentric to the first coaxial point.

3. The antenna mount of claim 1, wherein the first shaft is rotatable with respect to the first sidewall about a first coaxial point, and the first disc includes a non-circular profile having a first geometric center point that overlaps the first coaxial point.

4. The antenna mount of claim 1, wherein the first bracket further comprises:

a first flange extending from a side of the first base between the first and second sidewalls; and a second flange extending in parallel with the first flange from another side of the first base between the first and second sidewalls.

5. The antenna mount of claim 4 further comprising a second bracket that comprises:

a second base;

a first sidewall extending from the second base and attached to the first flange; and a second sidewall extending in parallel with the first sidewall of the second bracket from the second base and attached to the second flange.

6. The antenna mount of claim 5, wherein the first flange includes a recess and the first sidewall of the second bracket has a third cam slot, further comprising a second cam that includes:

a second shaft protruding from the first sidewall of the second bracket through the third cam slot and rotatable with respect to the first sidewall of the second bracket; and a second disc coupled with the second shaft and adapted to fit within the recess so that the first bracket is rotatable with respect to the first sidewall of the second bracket as the second shaft is rotated from the exterior of the first sidewall of the second bracket.

7. The antenna mount of claim 6, wherein the second shaft is rotatable with respect to the first sidewall of the second bracket about a second coaxial point, and the second disc includes a circular profile having a second center point eccentric to the second coaxial point.

8. The antenna mount of claim 6, wherein the second shaft is rotatable with respect to the first sidewall of the second bracket about a second coaxial point, and the second disc includes a non-circular profile having a second geometric center point that overlaps the second coaxial point.

9. The antenna mount of claim 6 further comprising a connecting member coupled between the adjustment plate and the second sidewall of the first bracket and coupled with an antenna dish of the satellite antenna, wherein the connecting member is adapted to move with a rotary motion of the adjustment plate so as to adjust an elevation angle of the antenna dish.

10. The antenna mount of claim 9, wherein the first and second sidewalls of the first bracket have slots aligned with each other to confine the movement of the connecting member therein.

11. The antenna mount of claim 6 further comprising a connecting member coupled between the adjustment plate and the second sidewall of the first bracket and coupled with an antenna dish of the satellite antenna, wherein the connecting member is adapted to move with a rotary motion of the first bracket so as to adjust an azimuth angle of the antenna dish.

12. The antenna mount of claim 6, wherein the tangential direction of the rotary motion of the adjustment plate is orthogonal to that of the rotary motion of the first bracket.

13. An antenna mount for a satellite antenna, the antenna mount comprising:

a first bracket comprising:

a first sidewall;

a second sidewall extending in parallel with and spaced apart from the first sidewall;

a first flange extending between the first and second sidewall; and a second flange between the first and second sidewall extending in parallel with and spaced apart from the first flange;

an adjustment plate attached to an inner surface of the first sidewall;

a first cam comprising:

a first shaft protruding from the first sidewall and rotatable with respect to the first sidewall; and a first disc coupled with the first shaft and adapted to rotate the adjustment plate with respect to the first sidewall as the first shaft is rotated from the exterior of the first sidewall;

a second bracket comprising:

a third sidewall attached to the first flange; and a fourth sidewall attached to the second flange; and a second cam comprising:

a second shaft protruding from the third sidewall and rotatable with respect to the third sidewall; and a second disc coupled with the second shaft and adapted to rotate the first bracket with respect to the third sidewall as the second shaft is rotated from the exterior of the third sidewall.

14. The antenna mount of claim 13, wherein the first shaft is rotatable with respect to the first sidewall about a first coaxial point, and the first disc includes a circular profile having a first center point eccentric to the first coaxial point.

15. The antenna mount of claim 13, wherein the first shaft is rotatable with respect to the first sidewall about a first coaxial point, and the first disc includes a non-circular profile having a first geometric center point that overlaps the first coaxial point.

16. The antenna mount of claim 13, wherein the second shaft is rotatable with respect to the third sidewall about a second coaxial point, and the second disc includes a circular profile having a second center point eccentric to the second coaxial point.

17. The antenna mount of claim 13, wherein the second shaft is rotatable with respect to the third sidewall about a second coaxial point, and the second disc includes a non-circular profile having a second geometric center point that overlaps the second coaxial point.

18. The antenna mount of claim 13, wherein the adjustment plate has a first cam slot and the first disc is adapted to fit within the first cam slot.

19. The antenna mount of claim 13, wherein the first flange includes a recess and the second disc is adapted to fit within the recess.

20. The antenna mount of claim 13 further comprising a connecting member coupled between the adjustment plate and the second sidewall and coupled with an antenna dish of the satellite antenna, wherein the connecting member is adapted to move with a rotary motion of the adjustment plate so as to adjust an elevation angle of the antenna dish.

21. The antenna mount of claim 20, wherein the first and second sidewalls of the first bracket have slots aligned with each other to confine the movement of the connecting member therein.

22. The antenna mount of claim 13 further comprising a connecting member coupled between the adjustment plate and the second sidewall and coupled with an antenna dish of the satellite antenna, wherein the connecting member is adapted to move with a rotary motion of the first bracket so as to adjust an azimuth angle of the antenna dish.

23. The antenna mount of claim 13, wherein the tangential direction of the rotary motion of the adjustment plate is orthogonal to that of the rotary motion of the first bracket.

24. An antenna mount for a satellite antenna, the antenna mount comprising:

an adjustment plate with a first cam slot;

a first bracket comprising:

a first sidewall; and a first flange including a recess;

a first cam adapted to attach the adjustment plate to the first sidewall, the first cam comprising:

a first shaft; and a first disc coupled with the first shaft and adapted to fit within the first cam slot so as to allow the adjustment plate to rotate in a first tangential direction; and a second cam comprising:

a second shaft; and a second disc coupled with the second shaft and adapted to fit within the recess so as to allow the first bracket to rotate in a second tangential direction orthogonal to the first tangential direction.

25. The antenna mount of claim 24, wherein the first shaft is rotatable about a first coaxial point, and the first disc includes a circular profile having a first center point eccentric to the first coaxial point.

26. The antenna mount of claim 24, wherein the second shaft is rotatable about a second coaxial point, and the second disc includes a circular profile having a second center point eccentric to the second coaxial point.

27. The antenna mount of claim 24 further comprising a connecting member coupled with the adjustment plate and an antenna dish of the satellite antenna, wherein the connecting member is adapted to move with a rotary motion of the adjustment plate so as to adjust an elevation angle of the antenna dish.

28. The antenna mount of claim 24 further comprising a connecting member coupled with the adjustment plate and an antenna dish of the satellite antenna, wherein the connecting member is adapted to move with a rotary motion of the first bracket so as to adjust an azimuth angle of the antenna dish.

29. The antenna mount of claim 24, wherein the first disc is rotatable with respect to the first sidewall as the first shaft is rotated from the exterior of the first sidewall.

30. The antenna mount of claim 24 further comprising a second bracket including a second sidewall attached to the first flange, wherein the second disc is rotatable with respect to the second sidewall as the second shaft is rotated from the exterior of the second sidewall.

* * * * *